US006712559B2

(12) United States Patent
Lenormand et al.

(10) Patent No.: US 6,712,559 B2
(45) Date of Patent: Mar. 30, 2004

(54) SEAFLOOR-SURFACE LINKING DEVICE COMPRISING A STABILIZING ELEMENT

(75) Inventors: Olivier Lenormand, Paris (FR); Michel Gassert, Saverne (FR); Stephane Couprie, Ville d'Avray (FR)

(73) Assignee: Saipem SA, Montigny le Bretonneux (FR)

( * ) Notice: Subject to any disclaimer, the term of this patent is extended or adjusted under 35 U.S.C. 154(b) by 0 days.

(21) Appl. No.: 10/181,179

(22) PCT Filed: Jan. 22, 2001

(86) PCT No.: PCT/FR01/00203

§ 371 (c)(1),
(2), (4) Date: Jul. 15, 2002

(87) PCT Pub. No.: WO01/53651

PCT Pub. Date: Jul. 26, 2001

(65) Prior Publication Data

US 2003/0000705 A1 Jan. 2, 2003

(30) Foreign Application Priority Data

Jan. 24, 2000 (FR) ..... 00 00865

(51) Int. Cl.[7] ..... E02D 15/00; E21B 43/01

(52) U.S. Cl. ..... 405/224.2; 405/223.1; 166/350; 166/367

(58) Field of Search ..... 405/200, 223.1, 405/224, 224.1, 224.2, 224.3, 224.4, 211, 211.1; 114/264; 166/350, 367, 355; 175/5, 6, 7

(56) References Cited

U.S. PATENT DOCUMENTS

| | | | | | |
|---|---|---|---|---|---|
| 3,248,886 | A | * | 5/1966 | Blenkarn | 405/211 |
| 4,099,281 | A | * | 7/1978 | Bowley | 441/6 |
| 4,176,986 | A | * | 12/1979 | Taft et al. | 405/211 |
| 4,193,234 | A | | 3/1980 | Wong | |
| 4,241,685 | A | * | 12/1980 | Mougin | 114/264 |
| 4,702,321 | A | * | 10/1987 | Horton | 166/350 |
| 4,768,984 | A | | 9/1988 | de Oliveira et al. | |
| 4,909,327 | A | * | 3/1990 | Roche | 166/359 |
| 5,706,897 | A | * | 1/1998 | Horton, III | 166/359 |
| 5,971,075 | A | | 10/1999 | Odru et al. | |
| 6,019,549 | A | * | 2/2000 | Blair et al. | 405/216 |
| 6,176,646 | B1 | * | 1/2001 | Finn et al. | 405/224.2 |
| 6,213,045 | B1 | * | 4/2001 | Gaber | 114/266 |
| 6,244,785 | B1 | * | 6/2001 | Richter et al. | 405/195.1 |
| 6,347,911 | B1 | * | 2/2002 | Blair et al. | 405/216 |
| 6,386,290 | B1 | * | 5/2002 | Headworth | 166/346 |

FOREIGN PATENT DOCUMENTS

| | | | |
|---|---|---|---|
| WO | WO 95/27101 | 10/1995 | E02B/17/00 |
| WO | WO 99/05389 | 2/1999 | E21B/17/01 |
| WO | WO 99/41142 | 8/1999 | B63B/35/44 |

OTHER PUBLICATIONS

*Proven New Technologies For Offshore/Onshore Applications*, Erdoel Erdgas Kohle, De, Urban Verlag, vol. 114, No. 6, Jun. 1998, p. 81 XPOOO799413.

* cited by examiner

*Primary Examiner*—Heather Shackelford
*Assistant Examiner*—Lisa M. Saldano
(74) *Attorney, Agent, or Firm*—Cohen, Pontani, Lieberman & Pavane

(57) ABSTRACT

A bottom-to-surface link with at least one underwater pipe having a portion with a substantially constant diameter and one or more floats in a string, the floats constituting cans surrounding the pipe and being located in a float zone around the top underwater portion of the pipe. The pipe is held at the surface by a guide device, preferably on a floating float support. The link includes at least one stabilizer situated in the top portion of the pipe. The link is arranged so that the bottom portion of the float zone, is preferably on or level with the lowest float and a transition zone is between the floats and the substantially constant diameter portion of the pipe.

15 Claims, 8 Drawing Sheets

SEAFLOOR-SURFACE LINKING DEVICE COMPRISING A STABILIZING ELEMENT

PRIORITY CLAIM

This is a U.S. national stage of application No. PCT/FR01/00203, filed on Jan. 22, 2001. Priority is claimed on that application and on the following application: Country: France, Application No.: 00/00865, Filed: Jan. 24, 2000.

BACKGROUND OF THE INVENTION

The present invention relates to the known field of bottom-to-surface links of the type comprising a vertical underwater pipe referred to as a "riser" connecting the bottom of the sea to a floating support installed on the surface.

Once the depth of water becomes large, production fields and in particular oil fields are generally worked from a floating support. In general a floating support has anchor means to enable it to remain in position in spite of the effects of currents, winds, and swell. It generally also has means for storing and processing oil and means for unloading to off-loading tankers. These supports are known as floating production storage off-loading (FPSO) supports and numerous variants have been developed such as submersible pipe alignment rigs (SPARs), which are long floating cigar-shaped objects held in position by catenary anchoring, or tension leg platforms (TLPs) where said legs are generally vertical.

Wellheads are often distributed over an entire field and production pipes together with water injection lines and control cables are disposed on the sea bed heading towards a fixed location with the floating support being positioned on the surface vertically thereabove.

Some wells are situated vertically below the floating support and the inside of the well is then directly accessible from the surface. Under such circumstances, the wellhead fitted with its "Christmas tree" can then be installed on the surface on board the floating support. It is then possible using a derrick installed on said floating support to perform all of the drilling, production, and maintenance operations required by the well throughout its lifetime. This is said to be a "dry" wellhead.

To maintain the riser fitted with the dry wellhead in a substantially vertical position, it is appropriate to exert upward traction which can be applied either by a cable tensioning system using hydraulic actuators or winches installed on the floating support, or else by using floats that are distributed at various depths along the riser, or indeed to use a combination of both techniques.

U.S. Pat. No. 2,754,011 in the name of IFP describes a barge and a guide system for a riser, which riser is fitted with floats.

In some oil wells, the depth of water exceeds 1500 meters (m) and can be as much as 3000 m, so the weight of a riser over such a depth requires forces that can reach or even exceed several hundreds of (metric) tonnes in order to keep them in position. Use is made of buoyancy elements of the "can" type which are added to underwater structures, mainly to risers connecting the surface to very great depths (1000 m to 3000 m). The underwater pipe then consists in a rising column comprising an underwater pipe assembled with at least one float comprising a can surrounding said pipe coaxially and having said pipe passing through it.

The means joining said can to said pipe preferably include a leakproof hinge assembled around said pipe at at least one of the top and bottom orifices of said can.

The floats in question are of large dimensions, and in particular of a diameter in excess of 5 m, and a length in the range 10 m to 20 m, and their buoyancy can be as much as 100 tonnes.

They are generally placed in a string one beneath another.

In general, the floats extend over a length corresponding to no more than about 10% of the length of the bottom-to-surface link, and in particular over a length of 100 m to 200 m.

The riser is put under tension by the floats and is guided, preferably at the floating support, by roller guides situated in a plane to hold and guide the riser relative to the floating support. Cable tensioning means acting as guides can be used.

FR 2 754 021 discloses a device for guiding a riser which is fitted at its top with floats, the device comprise wheels enabling the riser to slide vertically, and also enabling it to pivot about a horizontal axis, while guiding its horizontal displacements, such that the movements of the riser in horizontal translation follow substantially those of the floating support. Thus, FR 99/10417 discloses an improved guide device having wheels and friction pads disposed radially around the pipe. Finally, various guide systems are known that require tensioning to be performed by cable.

The entire riser then behaves like the string of an instrument under tension between the bottom of the sea and the point situated on the axis of the guidance system level with the floating support.

The riser is subjected to the effects of swell, of current, and in addition to the horizontal movements of said floating support which is itself likewise subjected to the same effects. Water movements in the depth of water create drag effects on the riser structure and on its floats, thereby giving rise to large forces of variable direction.

In certain configurations of water particle movement, interaction effects occur between the fluid and the riser which give rise to vortices being shed alternately from opposite sides of the riser as shown in FIG. 13.

When the period of these alternating vortex separations is close to the natural excitation periods of the riser, a phenomenon known as "capture" occurs which causes the riser to vibrate.

The intensity of the vibrations generated by shedding vortices during "capture" increases with increasing length of riser from which vortices are being shed simultaneously on the same side. This length is referred to by the person skilled in the art as the "correlation length".

If the riser is considered as being an instrument string that is attached at both ends, its overall behavior is subject to transverse displacements of several meters presenting a natural excitation frequency and harmonics corresponding to a mode referred to as "guitar mode", i.e. the riser vibrates between its two ends like a guitar string.

For risers without floats whose section characteristics (in particular diameter, second moment of area, stiffness) are substantially uniform or continuous, the only vibration observed is vibration of this "guitar" type as shown in FIGS. 3 and 4.

Similarly, for a high-buoyancy riser as in WO 99/05389 in which buoyancy is distributed over the entire length of the riser to obtain buoyancy of about 95% to 98%, the only vibrations observed are in "guitar" mode.

In WO 95/27101 and WO 99/05389, stabilizers are described for risers that are subjected to "guitar" type vibrations associated with the disturbing effects of vortices or turbulence around the riser.

In WO 99/05389, the floats are distributed along the entire length of the riser in the form of a cylindrical shell of syntactic foam. The stabilizer consists in modifying the shape of the floats in the top portion corresponding to the depth of water which is subject to swell, so as to obtain a non-cylindrical surface of hexagonal section. The solution proposed in WO 99/05389 reduces the volume of the floats in the top portion and thus reduces their buoyancy compared with the remainder of the riser for equivalent overall size. That type of plane geometry modification has the effect of increasing drag and decreasing the excitation induced by shedding vortices, and stabilizes the riser solely by absorbing energy.

In WO 95/27101, a tubular pipe that is likewise subjected to "guitar" mode vibration only, is stabilized by being fitted with a plurality of perforated envelopes at different levels around the standard portion of the pipe. These perforated envelopes are slidable around the pipe so as to be placed specifically at the locations of zones that are subjected to vibrations which correspond to vibration antinodes.

In U.S. Pat. No. 4,768,984, a stabilizer is described for a riser that is provided with a free buoy at its head, said buoy supporting an installation that includes a working platform. The surface installation creates unbalance by raising the center of gravity relative to the center of thrust or of buoyancy. Attempts are therefore made to bring the center of gravity and the center of buoyancy of the top portion of the pipe back into proximity and preferably into coincidence by adding a trellis or reinforcing structure constituting a mass below the float in order to compensate the weight of the structure above the float. The trellis or reinforcing structure has a special shape to avoid giving rise to any excessive increase in disturbances in the zone in question.

The present invention relates to stabilizing a bottom-to-surface link of a type that is different from those described in the prior art, and it proposes a novel solution for stabilization.

SUMMARY OF THE INVENTION

The present invention relates to a bottom-to-surface link comprising at least one underwater pipe having at least one float, and preferably a plurality of floats in a string, said floats being constituted by cans surrounding said pipe, and located in the top underwater portion of the pipe, said pipe being held at the surface by a guide device, preferably on a floating support, and the portion situated beneath the float zone being devoid of floats for the most part or completely.

As mentioned above, the term "guide device" is used herein to designate devices known to the person skilled in the art for allowing the riser to slide vertically, and also for allowing it to pivot about a horizontal axis while guiding its horizontal displacements, so that they are controlled and preferably substantially follow those of the floating support, where appropriate.

The inventors have discovered that with this type of riser having floats near the top only and having a support and guide system at the surface, a vibration phenomenon can be observed that is very different and that is accentuated, in which the top portion corresponding substantially to the length of the floats behaves like a pendulum whereas the bottom portion beneath the floats behaves in a manner that approximates to a "guitar" type phenomenon. The "pendulum" type behavior of the top portion of the riser is favored by the difference between the second moments of area between the two sections of the riser. This "pendulum" movement has a very significant influence on the behavior of the riser as a whole and coupling is then observed between "pendulum" mode and "guitar" modes, as shown in FIGS. 6 and 7. The overall behavior of the riser is then particularly sensitive to any excitation which tends to generate swinging motion in the top portion of the riser.

Thus, the problem of the invention is to prevent or reduce the appearance of vibration corresponding to combined "guitar-and-pendulum" type modes on risers that are tensioned by floats situated near the top, whenever they are excited by swell and current or indeed by the horizontal displacements of the barge, by reducing or preferably eliminating the pendulum-like behavior of the top portion of the riser.

More particularly, the inventors have shown that the problem posed is to avoid or reduce hydrodynamic phenomena that give rise to excitation of vibratory modes in the coupled "riser-and-float" system, and to avoid or reduce the response of the coupled "riser-and-float" system to the excitations.

Since this is typically a problem of the "fluid-and structure" coupling type, the interaction between the two aspects, i.e. excitation and system response, is large. The hydrodynamic phenomena and the movements of the barge act on the structure which in turn reacts on the excitation from which the hydrodynamic phenomena originate. The invention thus relates to installing devices that provide a solution to one or the other or both aspects of the problem.

The problem of the present invention thus relates, in a first aspect, to eliminating or reducing the excitation of vibratory modes of the coupled "riser-and-float" system. The inventors have shown that in this first aspect, the problem relates solely to using devices that have an influence on excitation of hydrodynamic origin of the vibratory modes due to vortices being shed from the outlines of the floats or the riser.

In a second aspect, the problem of the present invention also relates to eliminating or reducing the response of the coupled "riser-and-float" system to the excitations due to the hydrodynamic phenomena or to the horizontal movements of the barge.

The inventors have shown that in this second aspect, the problem relates to implementing devices seeking to modify the frequencies of the vibration modes of the coupled "riser-and-float" system so as to move away from the frequencies at which vortices are shed, thereby avoiding the "capture" phenomenon.

To do this, the present invention provides a bottom-to-surface link comprising at least one underwater pipe having at least one float and preferably a plurality of floats in a string, said floats being constituted by cans surrounding said pipe and being located in the top underwater portion of the pipe, said pipe being held at the surface by a guide device, preferably on a floating support. The portion situated beneath the float zone is thus devoid of floats for the most part, or even completely.

According to the present invention, said link includes at least one stabilizer situated in the top portion of the pipe and constituted by:

- the bottom portion of the float zone, preferably on or level with the lowest float; and
- the transition zone between the floats and the standard portion of substantially constant diameter of said pipe.

Said transition zone between the riser and the float(s) corresponds to a zone where the mechanical characteristics of the pipe (diameter, section or second moment of area of the pipe) decrease progressively going downwards until the standard part of the pipe is reached, corresponding to the part of the pipe that is of substantially constant diameter and situated beneath said transition zone.

The invention takes advantage of the very particular pendulum-like behavior of this type of bottom-to-surface link to contribute to stabilizing the system.

Stabilizers of the invention are advantageously located at the bottom end of the float zone, or beneath the string of floats, since the inventors have shown that this location corresponds to the zone where excitation from vortex shedding predominates. This excitation is closely tied to the amplitude of the horizontal displacement of the riser; and in this location the lever arm relative to the axis of rotation of the pendulum-type motion is greater. This location thus increases the stabilizing effect of the stabilizer. In addition, said location constitutes a singular point of said pipe since tension is at a maximum there.

Stabilizers of the invention thus make it possible to reduce or even eliminate both the excitation and the response of the vibratory modes of the coupled "riser-and-float" system.

More particularly, said stabilizer comprises at least one device selected from:

- an energy absorber device;
- a device increasing the mass of water entrained during movement thereof; and
- a device lowering the center of gravity of said top portion of the pipe.

Preferably, the stabilizer combines at least two and preferably three of the effects selected from:

- energy absorption;
- increasing the mass of water entrained during movements thereof; and
- lowering the center of gravity of said top portion of the pipe.

In an embodiment, energy is absorbed by a structural element that increases the contact area with the water and/or that creates a contact area with the water that is not cylindrical about the axis of said pipe.

Thus, the structural element can be constituted by:

- a modification of the shape of the surface of the float or the pipe, so that its shape is not cylindrical about the axis of said pipe; or
- an additional structural element associated with the surface of the float or of the pipe.

Said additional structural element increasing the contact area of the float or of the pipe with the water can present a surface having a shape that is three-dimensional or plane. This surface having a three-dimensional shape is preferably a surface that is not parallel to the cylindrical surface of the pipe.

Advantageously, said stabilizer comprises one of the following embodiments, taken separately or in combination:

- the non-cylindrical shape of the outside surface of a float or a portion of the pipe; and
- a helical ramp surrounding said float or said pipe.

As an example of said device lowering the center of gravity of the top portion of the pipe, mention can be made of a stabilizer having an additional mass situated in or around a float or surrounding said pipe.

In an embodiment, said stabilizer comprises a caisson, that preferably surrounds said pipe coaxially and whose outside surface has perforations. The term "perforation" is used to cover any gap or opening that allows water to pass into the caisson.

In certain embodiments, particularly when the stabilizer is a perforated caisson, it combines various aspects, specifically it consists in a device that lowers the center of gravity since it is situated in the bottom portion of the float zone, and in a device that increases the mass of water that is entrained during movement since it contains water, and in a device that absorbs energy by increasing drag due to the perforations in its surface.

As an example of a device providing additional mass, mention can be made of a non-perforated float that is partially or completely filled with water.

The invention thus consists in using in particular either additional devices such as perforated caissons or helixes, or else non-cylindrical floats of various shapes, or indeed a combination of these two types of solution.

In an embodiment, the float zone comprises a plurality of floats, and preferably at least four.

The stabilizer is preferably situated on or level with the lowest float, or in the transition zone immediately below the lowest float.

Said structural elements of three-dimensional shape absorb energy so as to limit the appearance of vortex shedding and/or reduce correlation lengths, while increasing the mass of water that is entrained.

Stabilizers operating by absorbing energy and increasing entrained water mass also contribute advantageously to modifying, and preferably reducing, the natural vibration frequencies of the "riser-and-float" system, and thus to reducing the response of the system to excitation due to hydrodynamic phenomena or to horizontal movements of the barge.

The invention also comprises implementing a stabilizer enabling the inertia of the string of floats to be increased by lowering its center of gravity, and also in a device enabling the mass of water that is entrained during its movement to be increased, which mass of water is known to the person skilled in the art as "added mass". These two types of stabilizer can coincide in a single device as mentioned above.

These devices for lowering the center of gravity and increasing the "added mass" have not only a favorable effect on the vibration frequencies of the coupled "riser-and-float" system, but also enable the top portion of the riser to be stabilized by increasing its inertia, thereby contributing to damping its swinging motion. These devices are also preferably installed on the bottom portion of the string of floats or beneath the floats where they are particularly effective since the dynamics of the coupled system are governed mainly by the swinging motion of the floats, and thus has a large influence on the natural frequency of oscillation of the moving riser, considered as a whole.

For risers that are grouped together in a bundle, vibratory modes are no longer excited solely by vortices being shed from the riser in question, but also due to flow interactions with other risers in the bundle. Implementing stabilizers of the present invention thus makes it possible to disorganize the wakes around the various risers and advantageously contributes to reducing the excitation of vibratory modes in adjacent risers.

The present invention also provides a bottom-to-surface link comprising a plurality of underwater pipes of the invention, i.e. comprising at least one stabilizer and grouped together in a bundle.

BRIEF DESCRIPTION OF THE DRAWINGS

Other characteristics and advantages of the present invention appear in the light of the following detailed description given with reference to the following figures, in which.

DETAILED DESCRIPTION OF THE PRESENTLY PREFERRED EMBODIMENT

Figure 1:
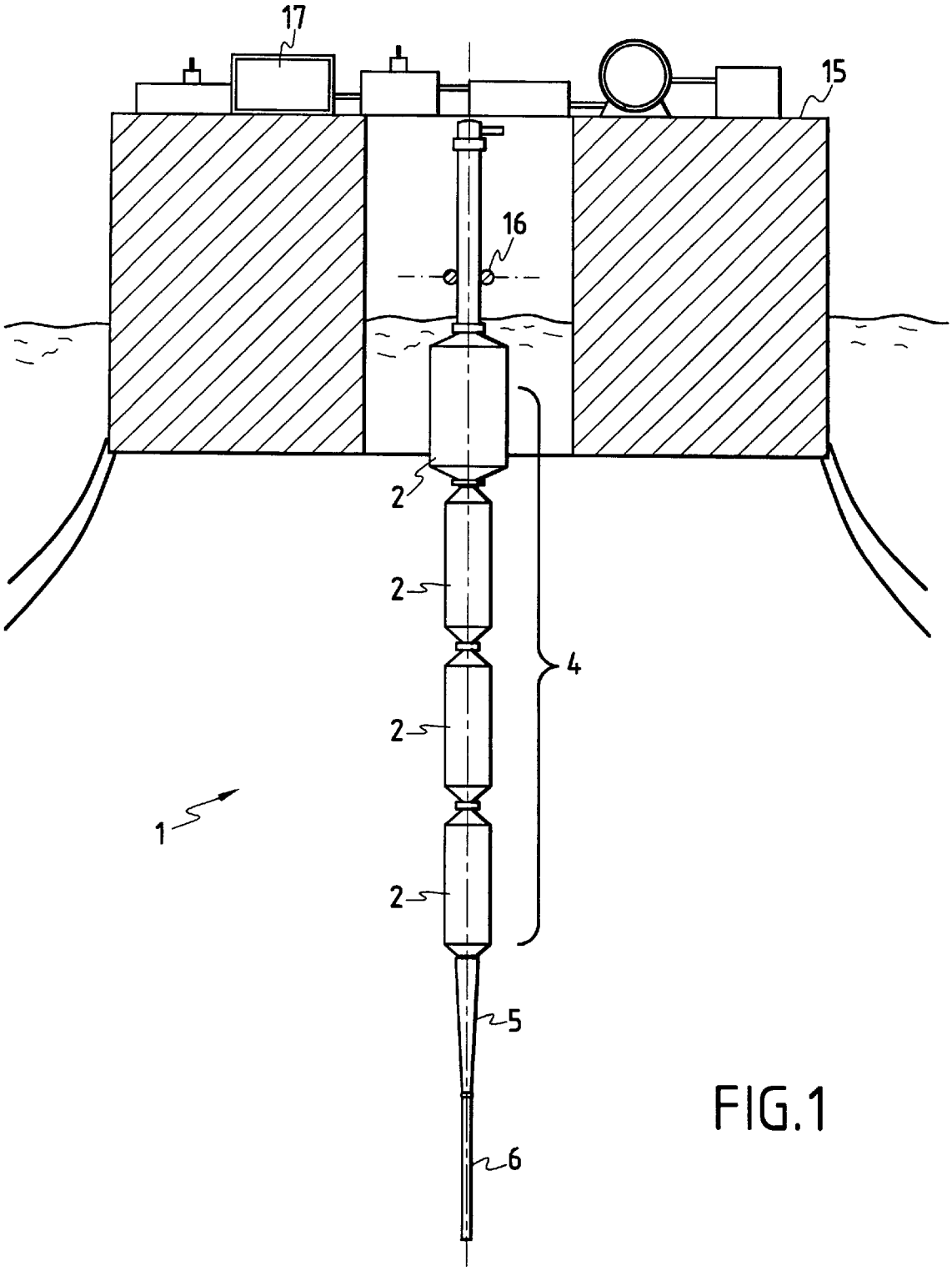
FIG. 1 is a side view of a riser fitted with floats associated with a side view in section of an anchored barge supporting processing equipment.

FIG. 1 is a side view of a bottom-to-surface link comprising a riser 1 fitted with four floats 2. The riser opens out into the drilling bay of the barge 15 which supports treatment equipment 17. The four floats constitute said float zone 4. The top float is of greater diameter and buoyancy, in particular since it is located entirely within the drilling bay, i.e. in a zone of the hull of the floating support where it is sheltered from the effects of swell and current.

The bottom portion of the link comprises a pipe 1 of substantially constant diameter, followed by a transition zone 5 that flares slightly immediately below the float zone. The top of the riser is guided by a guide system comprising a roller device 16 secured to the structure of said barge. These guide means enable said riser to slide along its longitudinal axis and they guide its lateral displacements in a horizontal plane perpendicular to said longitudinal axis of the riser. In FIGS. 1 to 12, the guide system is shown diagrammatically, with the structure securing it to the barge being omitted.

Figure 13:
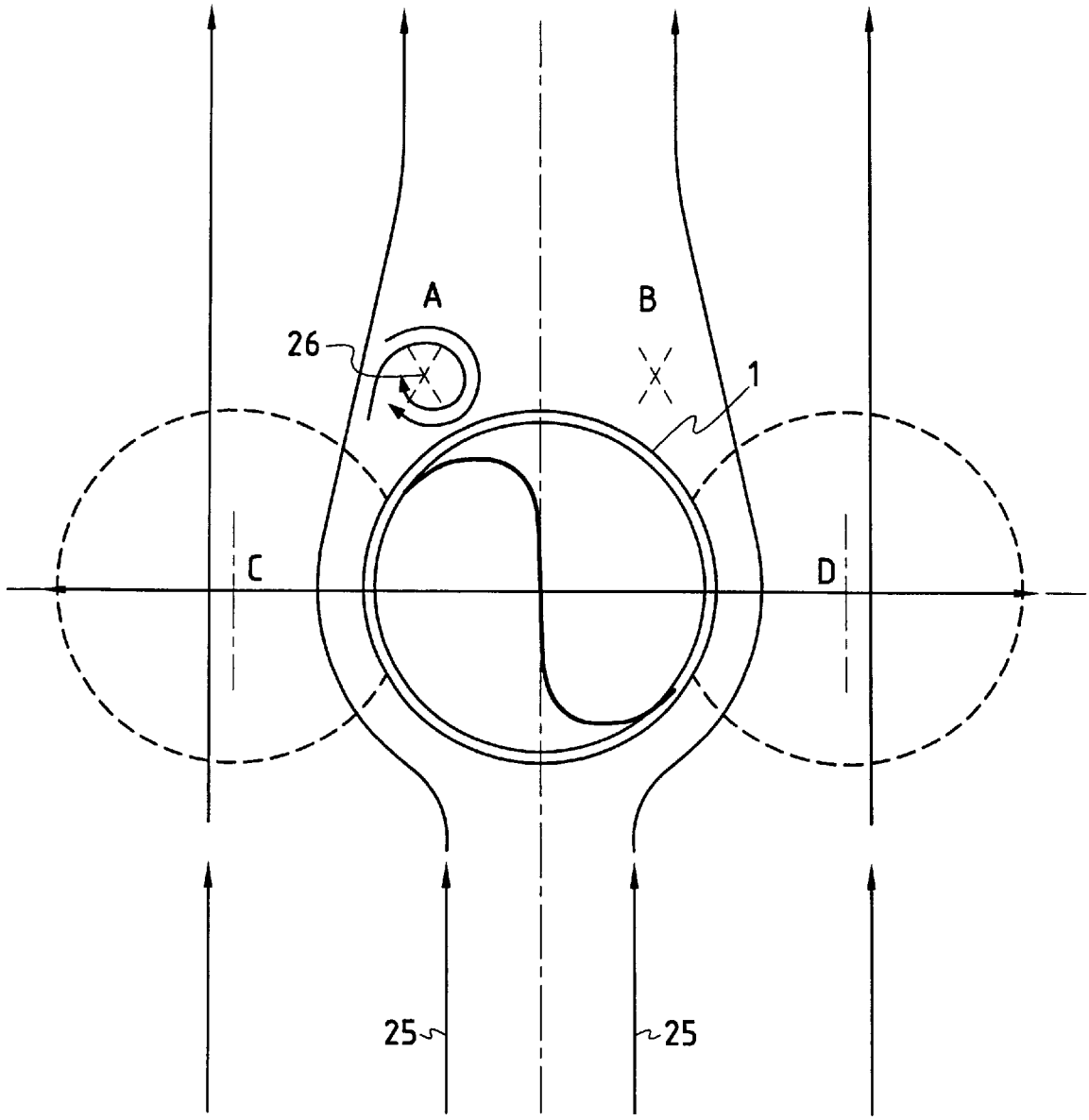
FIG. 13 is a section view through the top of a pipe subjected to current giving rise to vortices.

FIG. 13 is a section in plan view of a pipe 1 subjected to a current 25 which gives rise to turbulence downstream from said pipe.

The turbulence phenomenon is shown in position A. A vortex is initiated in this position, grows, and then separates from the structure, after which it is entrained by the current downstream away from the pipe. At the same time as a vortex is growing in position A, another vortex is initiated in position B, and it will grow subsequently. Position B is substantially symmetrical to position A about the current axis. Vortices are thus generated in alternation in positions A and B. This instability is referred to as "alternating vortex shedding". The appearance of a vortex is accompanied by a drop in pressure, and when vortices appear on the same side simultaneously over a sufficient height, e.g. on side A, then the lateral forces that are generated thereby tend to move the pipe to the left, i.e. towards position C. When a new vortex is generated in position B, it will then give rise to a pressure force towards the right, i.e. towards position D. Lateral pressure forces will thus follow one another on opposite sides of the pipe. When the excitation frequency associated with this instability is close to the natural frequencies of the pipe, then the pipe is caused to vibrate. The beginning of this vibration phenomenon is known as "capture".

The characteristics of this instability vary with parameters associated with the flow (speed) and with the shape of the pipe (diameter). It should be stated that in certain special circumstances, the vibration takes place in the same direction as the current instead of perpendicularly thereto, with vortices shedding no longer in "alternation" but "simultaneously", in both positions A and B of FIG. 13.

Figure 2:
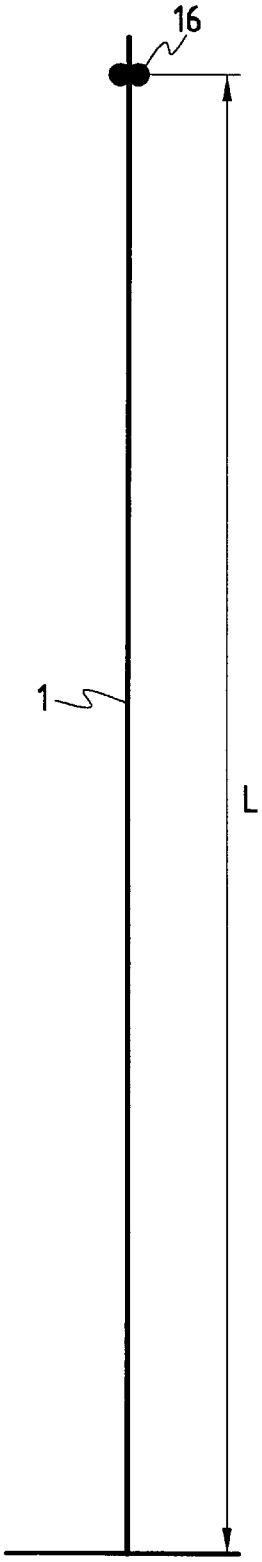
FIGS. 2, 3, and 4 are side views of a riser that is tensioned at its top by external means (not shown), shown respectively in a rest situation (FIG. 2), and in "guitar" type vibration respectively in mode 1 (FIG. 3) and in mode 2 (FIG. 4)
Figure 3:
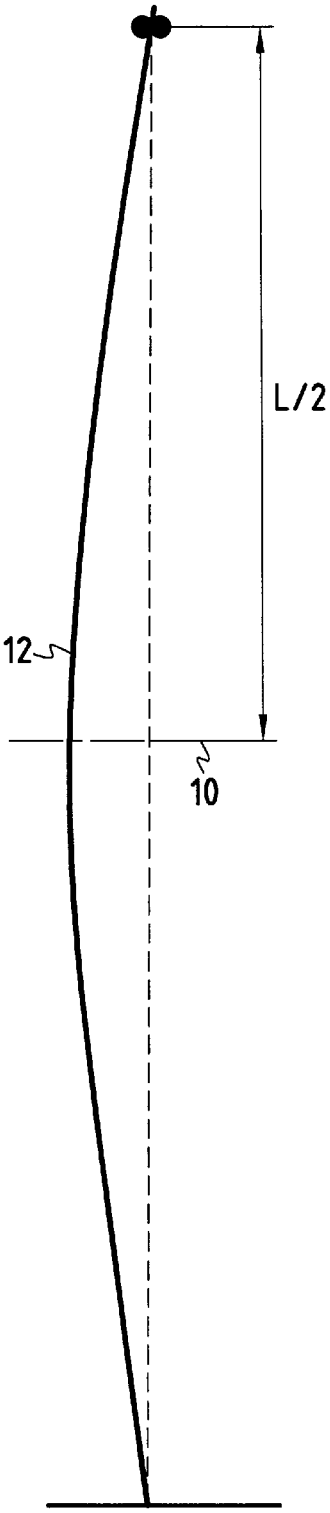
Figure 4:
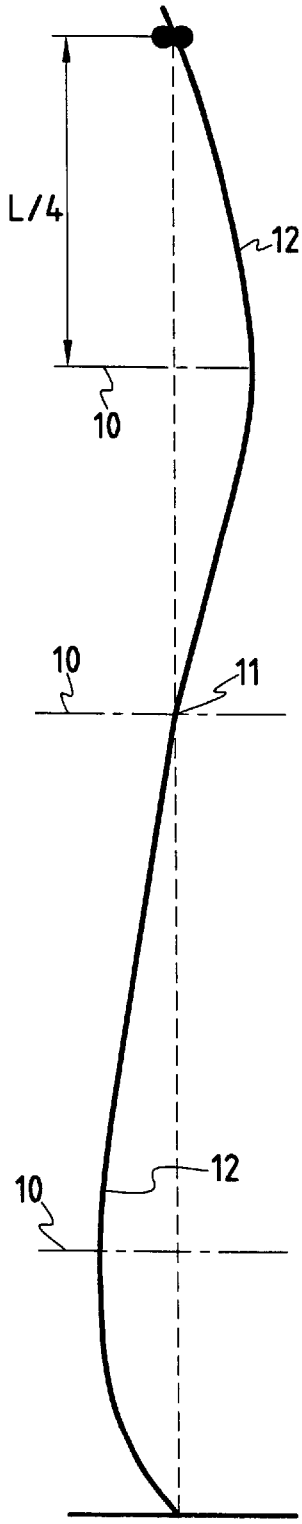

FIGS. 2, 3, and 4 are side views of a pipe 1 whose bottom end is secured and whose head end is tensioned by external means (not shown), and is guided by a roller device 16. These figures relate respectively to a rest situation (FIG. 2), and to a "guitar" type vibration situation, respectively in mode 1 (FIG. 3) and in mode 2 (FIG. 4).

In FIGS. 3 and 4, the antinodes 12 and the nodes 11 are formed in planes 10 situated substantially at L/2 or L/4.

Figure 5:
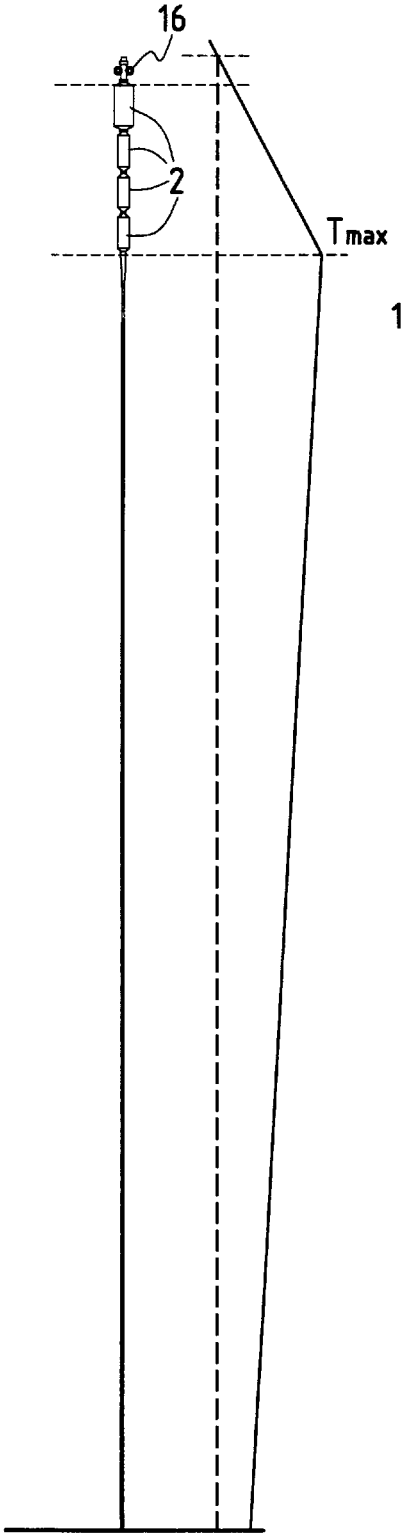
FIGS. 5, 6, and 7 are side views of a riser tensioned by floats, shown respectively in a rest situation (FIG. 5), and in "guitar-and-pendulum" type vibration situations, respectively in mode 1 (FIG. 6) and in mode 2 (FIG. 8)
Figure 6:
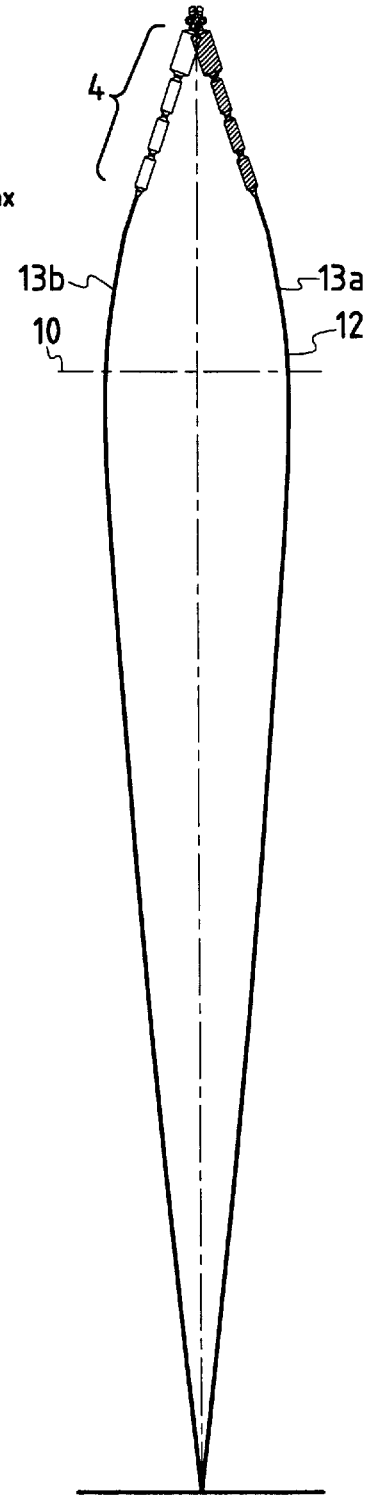
Figure 7:
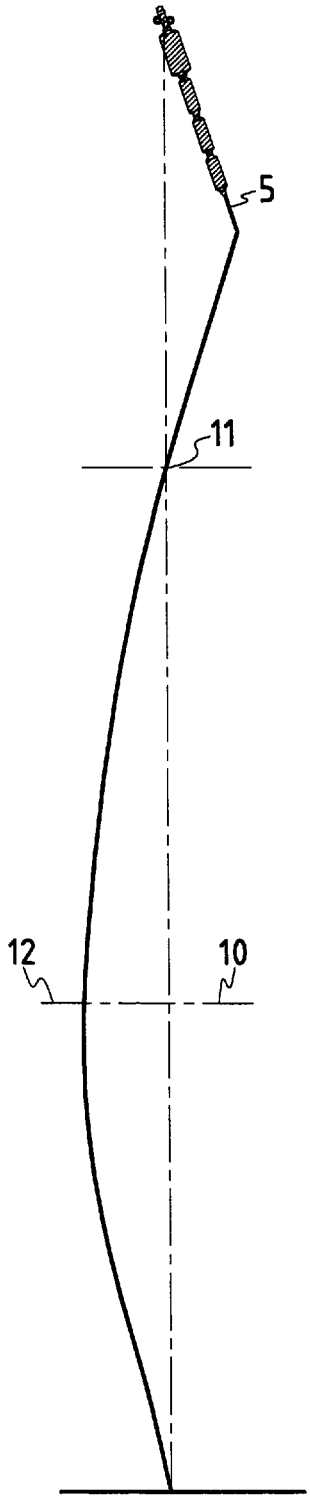

FIGS. 5, 6, and 7 are side views of a riser 1 tensioned by floats 2 and guided at its head end by a roller device 16, these figure relating respectively to a rest situation (FIG. 5), and to a "guitar-and-pendulum" type vibration situation respectively in mode 1 (FIG. 6) and in mode 2 (FIG. 7).

The deformation has been exaggerated considerably for clarity of description, and it shows that the planes 10 in which the nodes 11 and the antinodes 12 form are significantly shifted upwards. In FIG. 6, the riser oscillates between the two extreme positions shown 13*a*, 13*b*, whereas in FIG. 7 the riser is shown in only one of its extreme positions.

FIG. 5 shows to the right of the riser how tension in the riser varies substantially linearly along its longitudinal axis. Tension increases starting from the guide point. Tension is at its maximum (Tmax) at the junction between the float zone and the transition zone 5. Thereafter tension decreases with depth in the ordinary portion and confers a "vibrating string" type mode of deformation (FIGS. 6 and 7) also known as "guitar mode". In the float zone 4, the tension decreases on rising towards the surface and reverses to become compression in the portion of the riser that emerges above the top float to reach maximum compression above the guide system at the wellhead. This means that the top portion of the riser behaves like a pendulum pivoting about a fixed point at the head of the riser, which is the special feature of this type of riser which constitutes a vibrating coupled "pendulum-string" system under the effect of current and swell on the riser and on the barge.

In FIGS. 9 to 12 there can be seen stabilizers seeking to reduce or eliminate the swinging behavior of the top portion of the riser. These stabilizers are located in the float zone 4 or in the "riser-and-float" transition zone 5 which corresponds to a zone in which the diameter of the pipe decreases progressively going downwards until it reaches the standard portion of the pipe which corresponds to a portion of the pipe that is of substantially constant diameter and that is situated beneath said transition zone.

Figure 8:
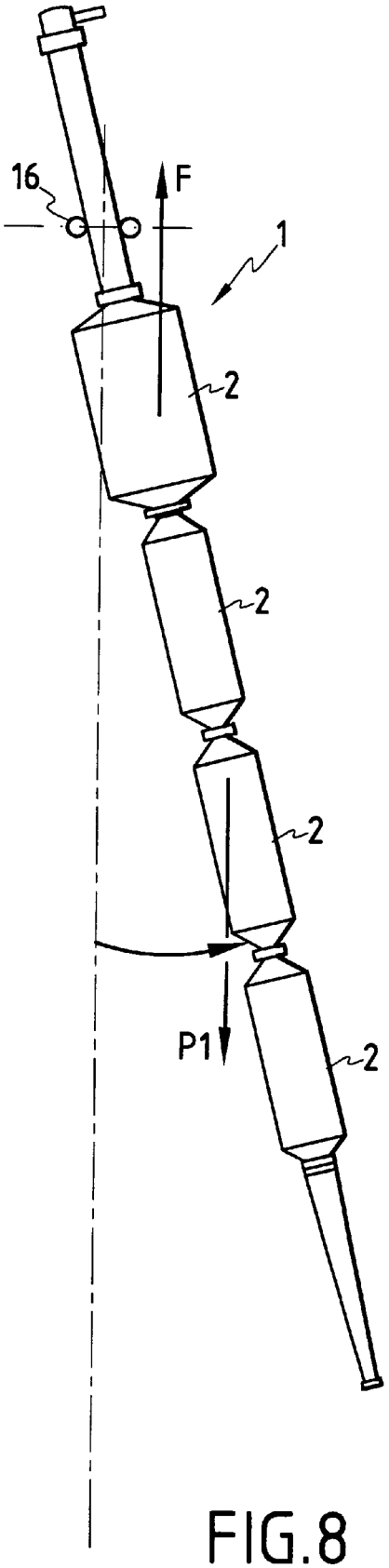
FIGS. 8 and 9 are side views of a riser having floats, the assembly being in an inclined position, thus making it possible to show more clearly the buoyancy force F and the mass force P associated with the center of gravity, respectively when there is no additional mass and when additional mass is present.
Figure 9:
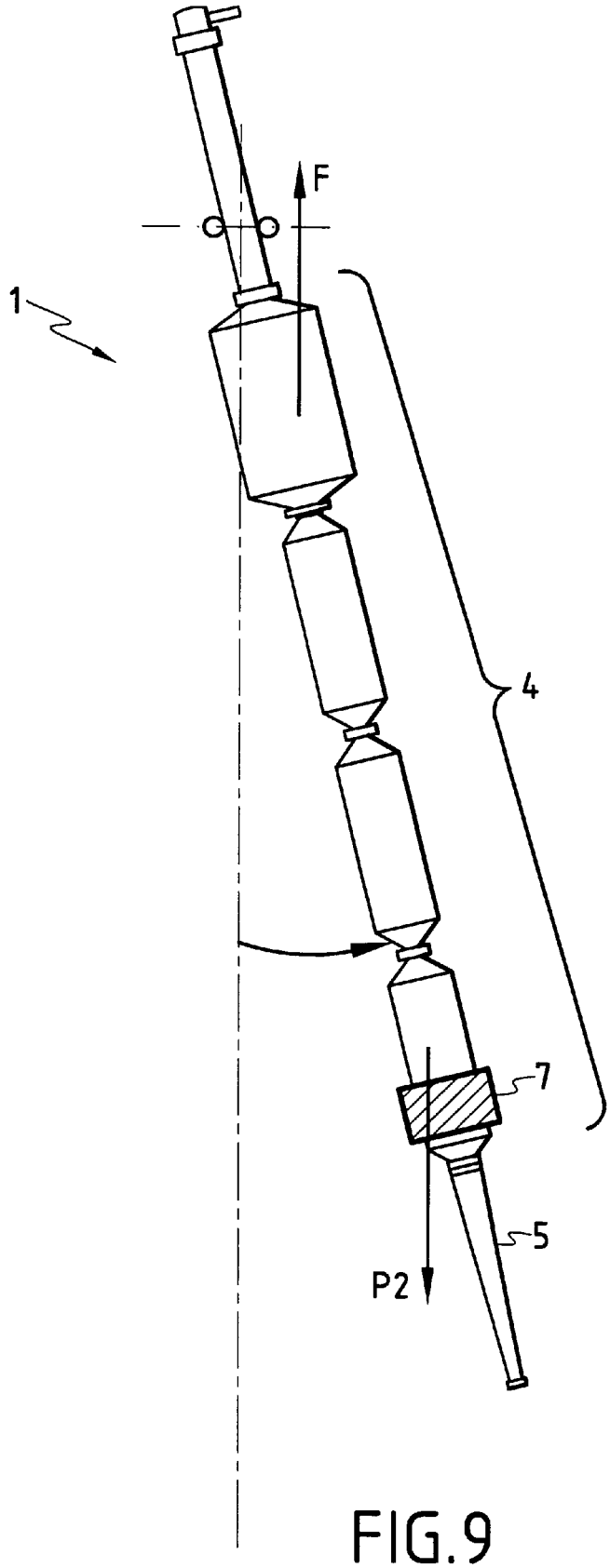

FIGS. 8 and 9 show the float zone and the buoyancy force F and the weight force P associated with the center of gravity of the assembly, respectively without any additional mass (FIG. 8) and with additional mass 7 installed in the bottom portion of the bottom float (FIG. 9). The additional mass 7 is obtained by an enclosure that surrounds the float and that contains a heavy compound such as iron ore. It could be constituted by a float that is itself filled with water.

In FIG. 8, the mass of the float zone corresponds to P1.

The additional mass 7 increases the mass from P1 to P2 and lowers the center of gravity. The return moment of the force P2 is thus increased, thereby having the effect of stabilizing the pipe.

Figure 10:
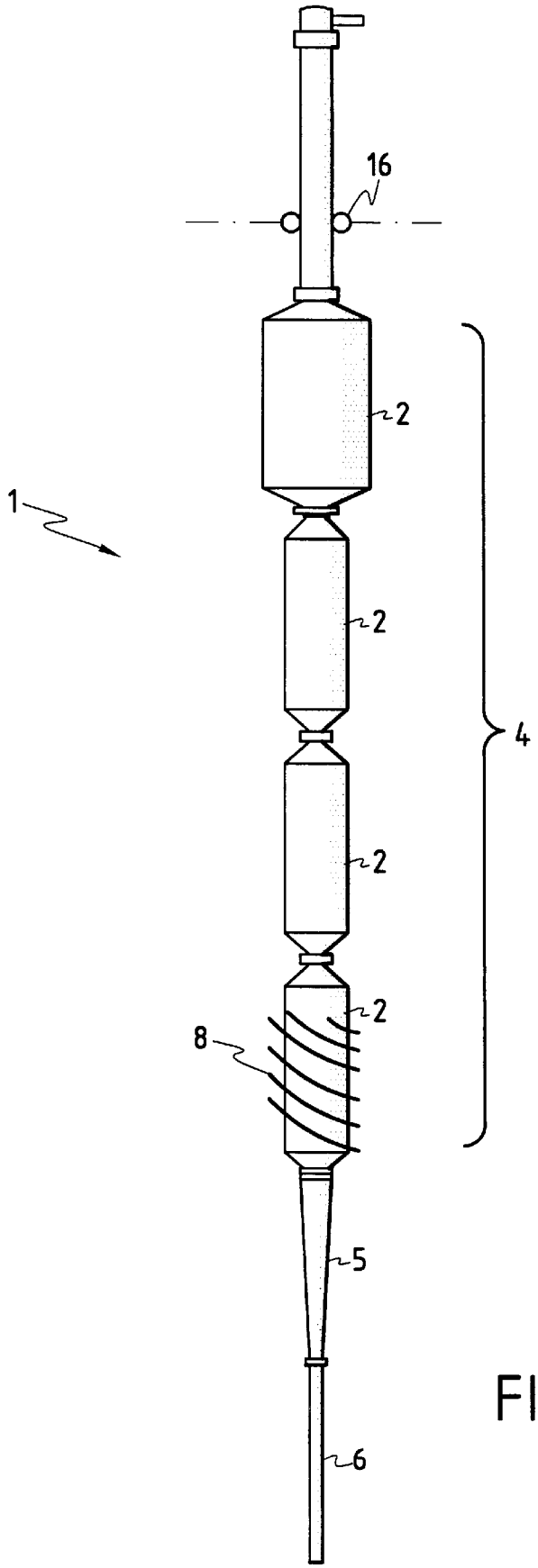
FIG. 10 is a side view of a riser having floats, with "helix" type energy absorbers being installed on the lowest float.

FIG. 10 is a side view of a riser 1 having floats 2, with "helix" stabilizers 8 comprising helical ramps installed on the lowest float, preferably in the bottom portion thereof. The helices 8 can advantageously be installed on the part constituting the transition zone 5 and situated immediately below the last float. The zone of maximum effectiveness lies in one of these two positions. The helices occupy a very small region only, e.g. extending over a height of 3 or 4 meters. Each helical ramp 8 extends around a fraction only of a turn about the outline of the float.

These structures of three-dimensional shape applied to the surface of the float confer a dual stabilization effect by absorbing energy and by increasing the mass of water, and can indeed also provide a third stabilization effect by lowering the center of gravity.

Figure 11:
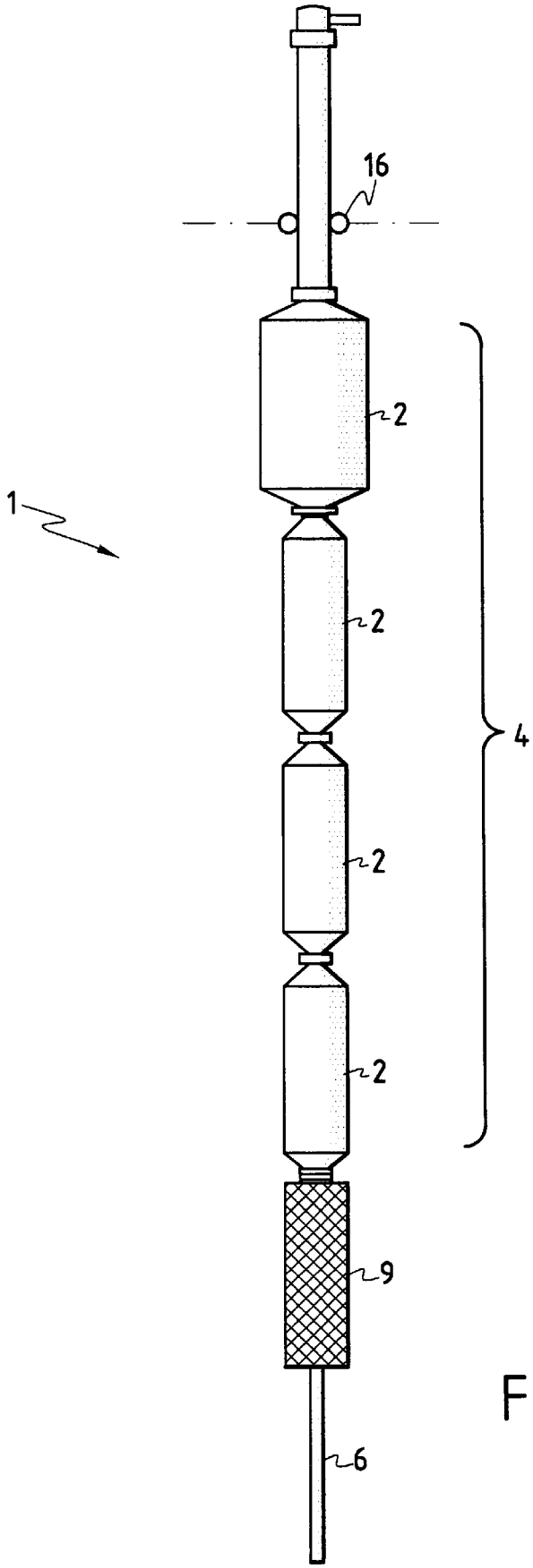
FIG. 11 is a side view of a riser having floats, and fitted with an energy absorber of the turbulence-generating perforated caisson type situated beneath and extending the lowest float.

FIG. 11 is a side view of a riser having floats 2 fitted with a stabilization device of the vortex perforated caisson type 9 situated below and extending the lowest float, e.g. in the transition zone, i.e. extending over a depth of about 50 m to about 100 m remote from the effects of swell. This caisson is constituted merely by an envelope pierced by holes of varying or constant section, and secured to the riser. The mass of water trapped inside the caisson can represent 20 tonnes to 50 tonnes and is set into motion during lateral displacements of the riser, so that its inertia opposes such displacements. The openings formed in the caisson allow limited movement of trapped water outwards and then inwards, thereby creating additional damping by energy absorption and thus considerably improving the stabilizing effect.

Finally, adding this caisson below the floats also confers a third effect of lowering the center of gravity.

Figure 12:
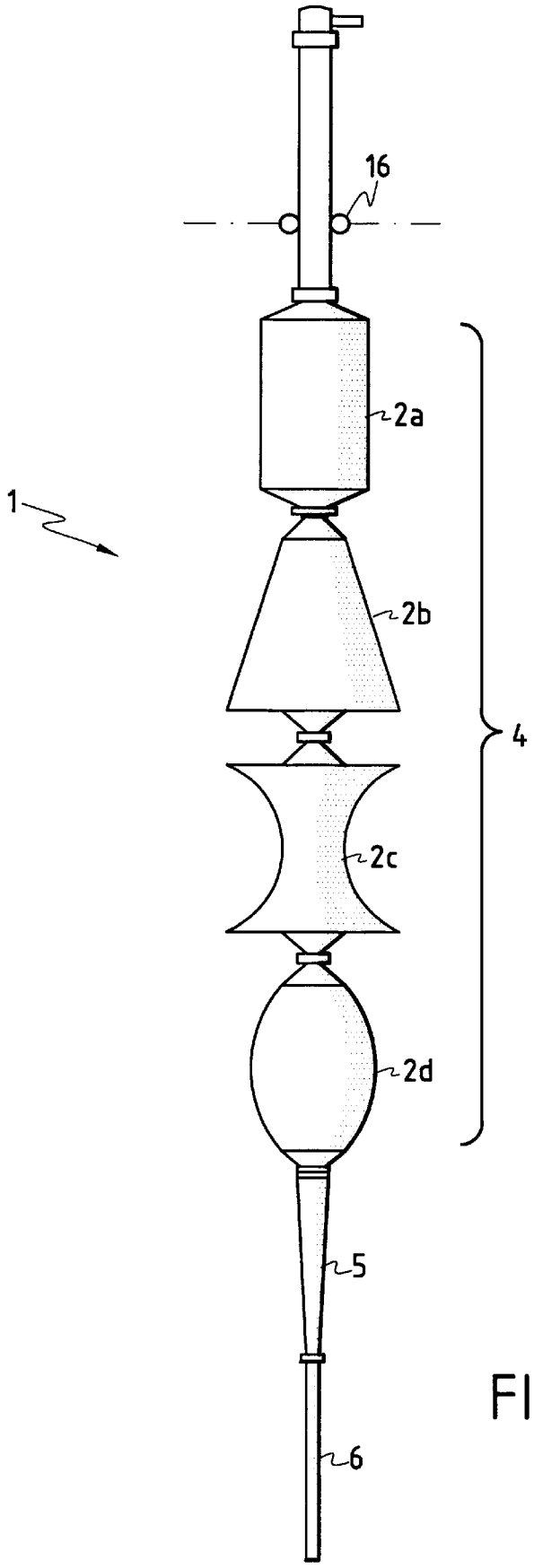
FIG. 12 is a side view of a riser fitted with floats having a variety of outside shapes in order to prevent vortices being shed.

FIG. 12 is a side view of a riser 1 fitted with floats 2 having a variety of outside shapes in order to absorb energy so as to prevent vortices from being shed since that can lead to capture effects.

Vortices are shed from the outside surfaces of floats or of pipes in the manner explained when describing FIG. 13. When the generator lines thereof are cylindrical 2*a*, then the vortices 26 tend to form simultaneously on the same side over varying lengths. Once the length becomes sufficiently long, e.g. 5 m or 10 m or even more, then the forces that are generated combine, and since they are all directed in the same direction they give rise to the "capture" phenomenon which leads to the riser being put into vibration.

By eliminating cylindrical generator lines in the floats 2, replacing them with a variety of shapes such as cones 2*b* or convex bodies of revolution 2*d* or concave bodies of revolution 2*c*, the risks of capture are reduced or even eliminated. These special shapes can also be constituted by external screens that are added to conventional cylindrical cans.

These special shapes are advantageously combined with other stabilizers such as filling the lowest float with water or associating a perforated caisson in the transition zone 5.

What is claimed is:

1. A bottom-to-surface link for linking the sea-bed to a floating support which floats on the surface of the water above the sea-bed, said floating support being displaceable horizontally by movement of said water, and said link comprising;

at least one underwater riser pipe extending between said surface of the water and said sea-bed, said pipe having:

a float zone in a top underwater portion of said pipe, and having at least a portion thereof which extends below said floating support, a portion with a substantially constant diameter positioned closer to said sea-bed than said float zone, and a transition zone positioned between said float zone and said portion with a substantially constant diameter, said transition zone having a diameter which progressively decreases along said pipe in a downward direction, and said pipe being capable of horizontal displacement;

a guiding device disposed on said floating support, for guiding the horizontal displacement of said pipe to follow the horizontal displacement of said floating support, and allowing said pipe to pivot about a horizontal axis;

at least one float surrounding said pipe and including a can directly attached to said pipe, said at least one float being disposed within said float zone; and a stabilizer, capable of reducing the vibration and movement of the guitar and pendulum type of said pipe, and located in the portion of said pipe located below said guiding device and bridging said float zone and said transition zone of said pipe.

2. A link according to claim 1, wherein said stabilizer comprises at least one device selected from:

an energy absorber device;

a device increasing the mass of water entrained during movement thereof; and a device lowering the center of gravity of said top portion of said pipe.

3. A link according to claim 2, wherein said stabilizer combines at least two effects selected from:

energy absorption;

increasing the mass of water entrained during movements thereof; and lowering the center of gravity of said top portion of said pipe.

4. A link according to claim 1, wherein said link comprises a structural element increasing its contact area with the water or creating a contact surface with the water that is not cylindrical about the axis of said pipe.

5. A link according to claim 1, wherein said stabilizer comprises a non-cylindrical shape of the outside surface of a float or of a portion of said pipe.

6. A link according to claim 1, wherein said stabilizer comprises at least one helical ramp surrounding one of said at least one float or said pipe.

7. A link according to claim 1, wherein said stabilizer comprises a coaxial caisson surrounding said pipe and having an outside surface with perforations.

8. A link according to claim 1, wherein the stabilizer comprises additional mass situated in or around said at least one float or surrounding said pipe.

9. A link according to claim 8, wherein said at least one float is partially filled with water.

10. A link according to claim 1, wherein said float zone comprises a plurality of floats.

11. A link according to claim 1, wherein said stabilizer is situated in the bottom portion of said float zone.

12. A link according to claim 1, wherein said stabilizer is situated in said transition zone.

13. A link according to claim 12, wherein said float zone comprises a plurality of floats whose outside surfaces have non-cylindrical shapes that are different with generator lines that can be straight or curved.

14. A link according to claim 1, comprising a plurality of said pipes grouped together in bundles.

15. A link according to claim 1, wherein said at least one float comprises at least two floats in a string, and said stabilizer is located in the part of said pipe bridging the float in said string closest to said sea-bed and said transition zone.

* * * * *